US005471928A

United States Patent [19]

Dimur et al.

[11] Patent Number: 5,471,928

[45] Date of Patent: Dec. 5, 1995

[54] CONTROL DEVICE AND METHOD FOR "ON THE FLY" PRINTING MACHINES

[75] Inventors: Gérard Dimur, Stains; Jean-Claude Haroutel, Orsay; Jean-Pierre Meur, La Ville du Bois, all of France

[73] Assignee: Neopost Industrie, Bagneux, France

[21] Appl. No.: 981,224

[22] Filed: Nov. 25, 1992

[30] Foreign Application Priority Data

Nov. 29, 1991 [FR] France ..... 91 14807

[51] Int. Cl.[6] ..... B41F 33/16

[52] U.S. Cl. ..... 101/235; 101/233; 101/255; 101/256; 400/582; 226/29; 226/122

[58] Field of Search ..... 101/235, 233, 101/234, 285, 484, 286, 485, 486; 400/279, 545, 582, 596, 708; 395/101; 226/27, 29, 122

[56] References Cited

U.S. PATENT DOCUMENTS

| | | | |
|---|---|---|---|
| 4,023,489 | 5/1977 | Beery | 101/235 |
| 4,220,084 | 9/1980 | Maclean et al. | 101/235 |
| 4,579,054 | 4/1986 | Buan et al. | 101/235 |
| 4,787,311 | 11/1988 | Mol | 101/232 |
| 5,018,443 | 5/1991 | Bolger | 101/235 |
| 5,103,733 | 4/1992 | Drapatsky et al. | 101/485 |

FOREIGN PATENT DOCUMENTS

| | | |
|---|---|---|
| 0177057 | 4/1986 | European Pat. Off. . |
| 2268733 | 11/1975 | France . |

*Primary Examiner*—Edgar S. Burr
*Assistant Examiner*—John S. Hilten
*Attorney, Agent, or Firm*—Sughrue, Mion, Zinn, Macpeak & Seas

[57] ABSTRACT

A control device for on the fly printing machines, especially machines for franking envelopes, comprises a printing device comprising a rotary print head actuated by a first motor and carrying on a portion of its surface a printing active part. A conveyor device for conveying the envelopes is actuated by a second motor and feeds the envelopes into contact with the printing device at a given conveyor speed and evacuates franked envelopes. The rotation speed of the first motor is optimized so that the tangential speed of the print head is held equal to the conveyor speed during a printing phase corresponding to the period during which an envelope is in contact with the active printing part and as close as possible to the conveyor speed during a complementary catch-up phase. The conveyor speed is optimized so that the conveyor speed is as low as possible whilst preventing overlapping of envelopes arriving on the conveyor device.

6 Claims, 3 Drawing Sheets

CONTROL DEVICE AND METHOD FOR "ON THE FLY" PRINTING MACHINES

BACKGROUND OF THE INVENTION

1. Field of the Invention

The field of the invention is that of mailing and in particular that of mailing systems capable of processing a large number of mail items at high speed.

To be more precise, the invention concerns the franking of mail in such systems.

2. Description of the Prior Art

As a general rule, known types of high-speed mailing systems comprises at least one inserter machine and a franking machine. The inserter machine folds the enclosures to be mailed and inserts them in the envelopes. It feeds the envelopes one by one to the franking machine, also called a printing machine, which prints various information such as mailing symbols (postage stamp and office stamp) and promotional material.

The invention is therefore concerned with these franking machines and more precisely with optimizing their operation and in particular the franking speed. In other words, the invention concerns an optimized control device for a printing machine which is part of a mailing system.

A printing machine usually comprises the following parts:

- a print drum incorporating the print head (carrying the information to be printed on the envelopes);
- a security system often comprising an assembly including an obturator bar locking the print drum drive system;
- conveyor means which deliver envelopes from the inserter device to the franking station of the printing machine and eject the envelopes after the print head has printed the mailing symbols and the promotional material.

The mailing symbols and the promotional material are printed as the print drum moves at a constant speed sometimes called the "printing speed".

It is obvious that to print correctly during this printing phase the tangential speed at the surface of the drum must be equal to that of the mail item at the printing location. This is achieved if the "conveyor speed" at which the conveyor means deliver the envelopes from the inserter machine is equal to the printing speed throughout the printing phase.

The rest of the time, that is to say when there is no printing taking place, the drum is usually stopped. When an envelope is fed in the drum starts and accelerates up to the printing speed.

This first type of printing machine has the major drawback of restricting the throughput of the mailing system as a whole because during each printing cycle (to frank an envelope) the print drum must be stopped completely and the security system engaged and disengaged.

The print drum must run up from zero speed to the printing speed before printing the symbols and is then decelerated to a stop after printing. The obturator bar must then be returned to the rest position (the position which disables printing).

Consequently, to increase the overall system throughput the inserter machine must increase the speed with which mail is ejected, which involves increasing the printing speed of the print drum. The magnitudes of the print drum deceleration and acceleration are increased accordingly.

A conventional solution to this problem is to use more powerful motors to obtain a higher speed and a higher torque. Apart from increasing the physical size of the machine, this increases the power consumption and the heat dissipation, which increases the cost of the system.

Also, operation of the franking machine at a higher speed and with higher acceleration and deceleration leads to premature wear of the machine and its drive system.

The higher the speed, the harder the acceleration and deceleration and the faster the movement of the obturator, which causes numerous impacts harmful to the mechanical parts.

These impacts cause a high noise level in operation which is very uncomfortable for the mailing system user and others in the immediate environment, especially in the event of regular or especially continuous use.

A second type of printing machine has been designed with the aim of increasing the throughput of a mailing machine incorporating a franking machine whilst reducing the drawbacks in terms of wear of the system as explained above. This machine is described in the patent document U.S. Pat. No. 2,619,643.

In this second type of printing machine three independent drive mechanisms respectively:

- conveying mail items,
- rotating the drum of the franking machine,
- moving the obturator bar of the franking machine, are controlled by a single microcomputer providing centralized control of the various actuators.

Means for sensing the entry speed of the envelopes and means for sensing triggering according to the position of the envelope supply data to the microcomputer which controls the various mechanisms of the machine so that:

- the printing speed of the print drum is the minimum speed required,
- during each print cycle, the conveyor speed is equal:
  - to the printing speed during printing, and
  - to the envelope arrival speed (greater than the printing speed) before deceleration and after acceleration,
- during each cycle, the speed of the print drum and therefore that of the print head is:
  - equal to the printing speed during printing, and
  - zero before acceleration and after deceleration to enable positioning of the obturator.

By simultaneously controlling the envelope arrival rate and the speed of the drum these machines are able to provide a higher throughput than machines of the first type described above. However, the need to stop the drum completely during each cycle remains a factor limiting the throughput of the mailing system as a whole.

With this type of machine it is necessary to manipulate an obturator during each cycle. The machine is therefore still subject to sudden stopping of the print head drum and its drive system which inevitably causes vibration, wear and noise.

Finally, to minimize the printing speed of the print drum in such machines the conveyor speed is caused to vary between a high value (the envelope entry speed, that is to say the speed of the envelopes on leaving the inserter machine) and a low value (the printing speed) which is required to be as low as possible. In other words the conveyor speed varies continuously between a printing phase and an envelope feeding phase. Controlling the various speeds is therefore complex and it is difficult to optimize these speeds.

The U.S. Pat. No. 4,023,489 describes a printing device in which the conveyor speed is constant and in which the tangential speed of a print drum varies between zero and the conveyor speed but does not return to zero if the documents to be printed arrive at a rate which is at or above a fixed value.

Consequently the magnitude of variations in the drum speed is usually reduced as compared with machines in which the drum is stopped in each cycle. However, this machine has the drawback that the amplitude of variation remains high when the arrival throughput is low in comparison with the maximal throughput allowed by the machine because the conveyor speed and therefore the speed of the drum during printing is fixed and remains equal to a value corresponding to the maximal throughput of the machine.

Furthermore, if a low conveyor speed is chosen it limits the throughput of the printing device unnecessarily.

A particular objective of the invention is to alleviate these various drawbacks of the prior art. To be more precise, an objective of the invention is to provide a printing machine control device enabling reduction of vibration and impact caused by operation of the drum, in particular to reduce wear and the operating noise of the machine, whilst allowing the throughput of the mailing system of which the printing machine is part to be increased.

Another objective of the invention is to provide a device of this kind which is simple, reliable and of low cost, especially in comparison with existing devices such as those described previously.

Another objective of the invention is to provide a device of this kind which enables optimized operation of the franking machine irrespective of the envelopes processed, their number and their rate of arrival.

SUMMARY OF THE INVENTION

These objectives and others that will emerge hereinafter are achieved in accordance with the invention by an on the fly printing machine control device, in particular a device for controlling a machine for franking envelopes, comprising:

printing means comprising a rotary print head actuated by a first motor and carrying on a portion of its surface a printing active part;

conveyor means for conveying said envelopes actuated by a second motor and feeding said envelopes into contact with said printing means at a given conveyor speed and for evacuating franked envelopes;

means for optimizing the rotation speed of said first motor operative such that the tangential speed of said print head is held equal to said conveyor speed during a printing phase corresponding to the period during which an envelope is in contact with said active printing part and as close as possible to said conveyor speed during a complementary catch-up phase; and means for optimizing said conveyor speed operative such that said conveyor speed is as low as possible whilst preventing overlapping of envelopes arriving on said conveyor means.

In this way the printing speed of the print head is as low as possible and the magnitudes of print head deceleration and acceleration are further reduced.

Thus operation of the printing machine at a slower speed enables further reduction of vibration, wear and noise whilst achieving the same throughput.

Said optimized conveyor speed is advantageously selected from a finite number of predetermined values.

The invention also concerns a method implemented in control devices of this kind comprising the following steps:

determining the rate of arrival of documents on said conveyor means, calculating a catch-up speed to be applied to said first motor during said catch-up phase according to said document arrival rate, determining the difference between said catch-up speed and said conveyor speed, correcting said conveyor speed if said speed difference is greater than a predetermined threshold.

Other features and advantages of the invention will emerge from the following description of one preferred embodiment of the invention given by way of non-limiting example only with reference to the appended drawings.

the print cycle includes a compensation phase in which the print head is decelerated;

the print cycle is completed by returning the print head to the stop point;

the print cycle includes a compensation phase in which the print head is accelerated.

Figure 5A:
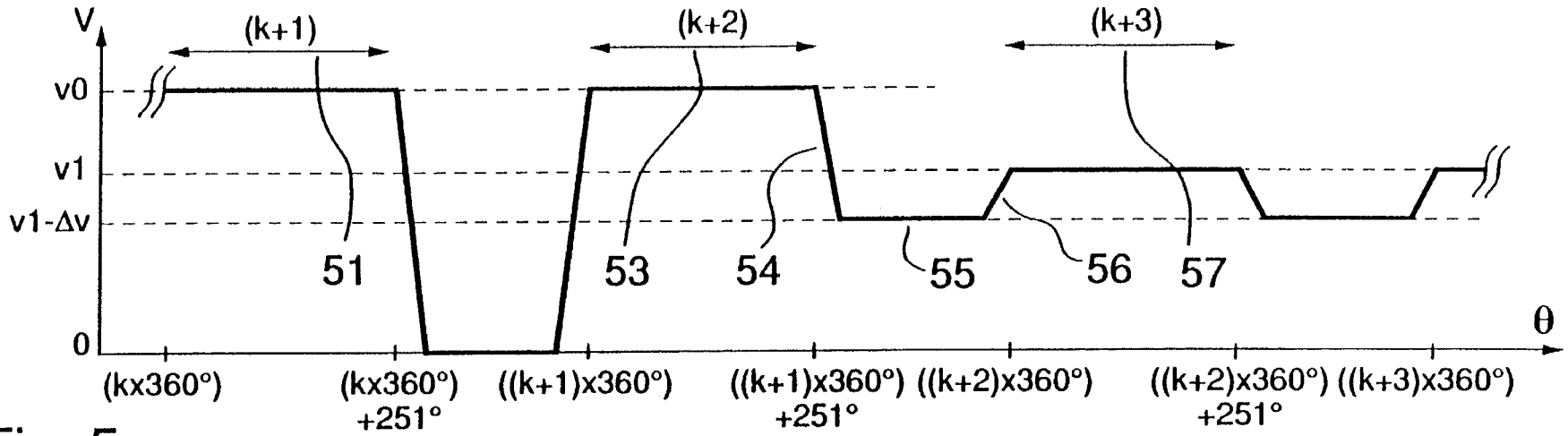
Figure 5B:
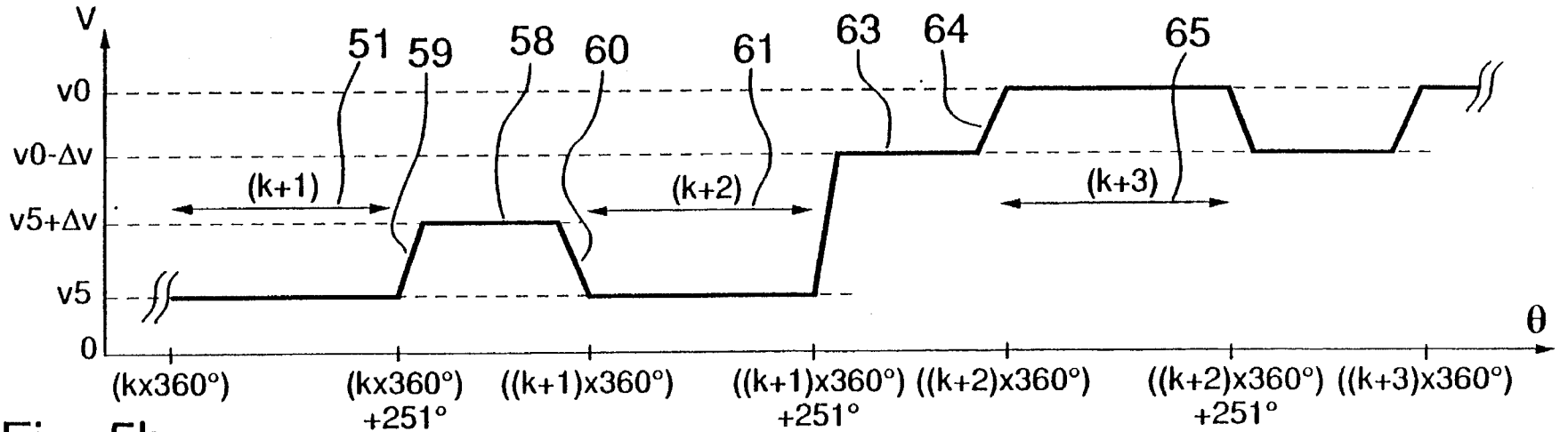

FIGS. 5*a* and 5*b* are curves showing the variation in the print head speed V as a function of the print head angular position θ in learning phases in which, respectively:

the envelope entry rate is increasing;

the envelope entry rate is decreasing or the print head rotation speed is too high relative to this rate.

DETAILED DESCRIPTION OF THE INVENTION

The invention therefore applies to a printing machine used in particular for franking envelopes in a mailing system.

This printing machine comprises:

conveyor means for feeding envelopes at a so-called "conveyor speed", print means including a rotary print head.

Figure 1:
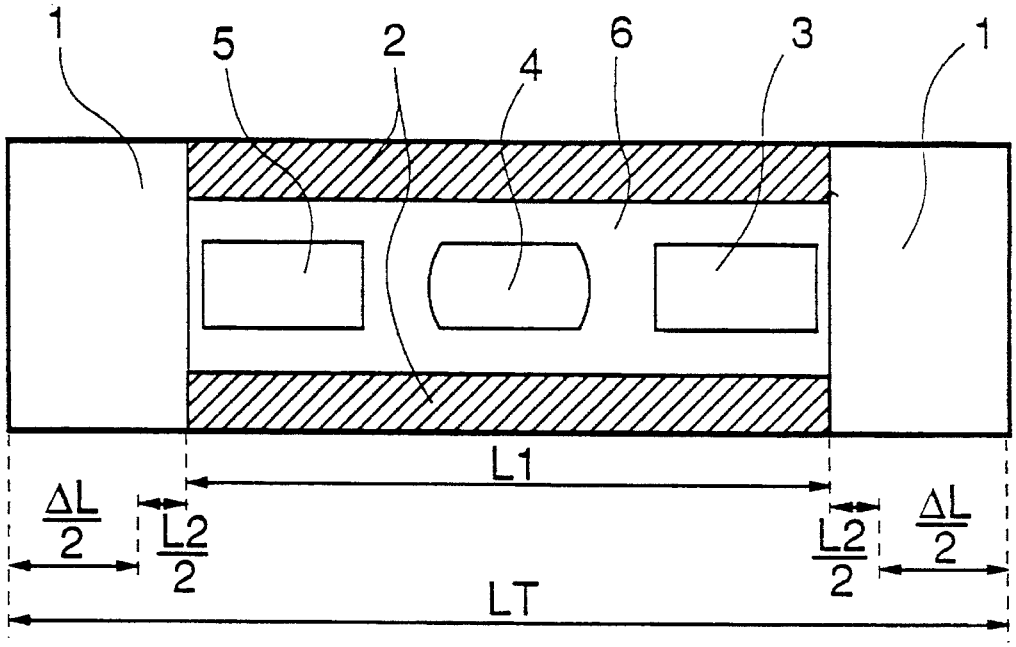
FIG. 1 shows a known type print head as widely used in printing machines developed flat.

The print head is shown developed flat in FIG. 1.

Not all the circumference of the print head is used for printing. The actual printing area corresponds to that of the band 2 which feeds the envelope throughout the printing phase.

In an area 6 the same length as the band 2 there are usually three inking stamps 3, 4, 5 respectively printing:

the postage stamp, the post office stamp, promotional material.

As soon as printing on the envelope is finished, that is to say at the end of the area 6 (and therefore of the band 2), the print head continues to rotate but not in contact with the envelope.

For good printing it will be understood that throughout the printing phase, that is to say throughout the time for which the band is in contact with the envelope, the speed of the print head must be equal to the conveyor speed.

Figure 2A:
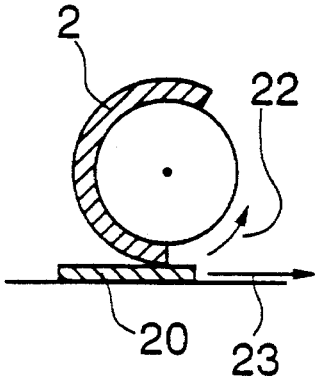
FIGS. 2*a* through 2*c* are a diagrammatic representation of an envelope printing cycle.
Figure 2B:
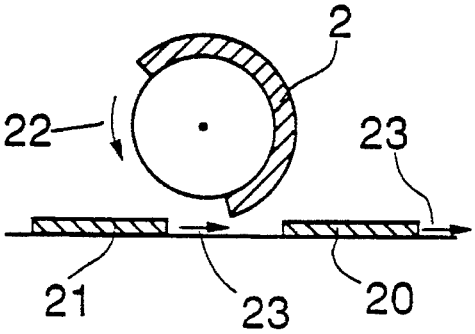
Figure 2C:
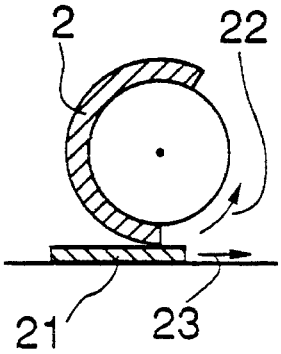

FIGS. 2*a* through 2*c* are a diagrammatic representation of a printing cycle.

In FIG. 2*a* the band 2 is in contact with an envelope 20. The print head is turning in a direction 22 and the envelope is moving forward in a direction 23.

The speed of the print head is then equal to the conveyor speed: this is the start of printing position.

The distance between two start of printing positions (that is to say the length of a letter plus the gap between consecutive letters) being greater than or less than the circumference of the print head, the print head must be decelerated or accelerated to compensate for this difference in length.

The speed of the print head must not vary:

when the band of the print head is in contact with the envelope (length L1), during relative engagement and disengagement of the envelope and the band (length L2).

If LT denotes the circumference of the print head, the print head speed can therefore vary over the length:

$$\Delta L = LT - (L1 + L2)$$

The lengths L1, L2, LT and ΔL are shown in FIG. 1.

Rather than reason with distances using a view of the print head developed flat, the remainder of this description uses an angular notation corresponding to a circular representation of the print head.

Figure 3:
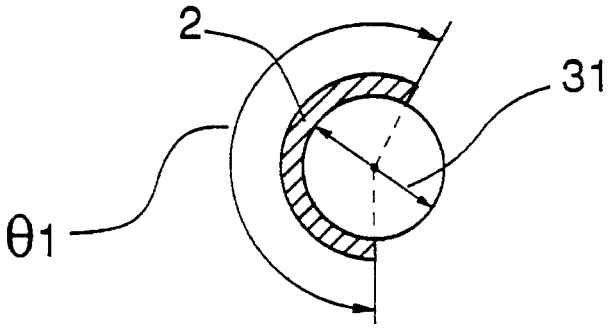
FIG. 3 is a simplified diagrammatic view of the print head shown in FIG. 1.

FIG. 3 is a diagram of the print head whose diameter 31 is constant irrespective of the machine. The print head diameter is usually 80 mm.

The band 2 subtends an angle θ1. The angle corresponding to the circumference of the head is denoted θT (this is 360° of course,).

θ2 and Δθ are respectively the angles corresponding to L2 and ΔL. The standardized values of these angles are:

θ1=214°50'

θ2=36°10'

θ1+θ2=251°

Δθ=θT−(θ1+θ2)=109°

This means that rotation of the print head at constant speed during the printing phase corresponds to rotation through 251°.

Distance compensation is therefore absolutely necessary while the print head is travelling the remaining 109°.

Referring to FIG. 2*b*, printing of the envelope 20 having finished, the print head continues to turn but at a different speed in order to be synchronized with the next envelope 21. FIG. 2*c* shows the start of the next printing phase: the start of the envelope 21 is aligned with the band 2.

When the printing machine is operating regularly, there are three possible situations:

during each cycle, after the printing phase, the print head must slow down to position the band correctly relative to the next envelope, the envelope to be franked is the last envelope and the print head must then return to the stopped position, during each cycle, after the printing phase, the print head must accelerate to position the band correctly relative to the next envelope.

Figure 4A:
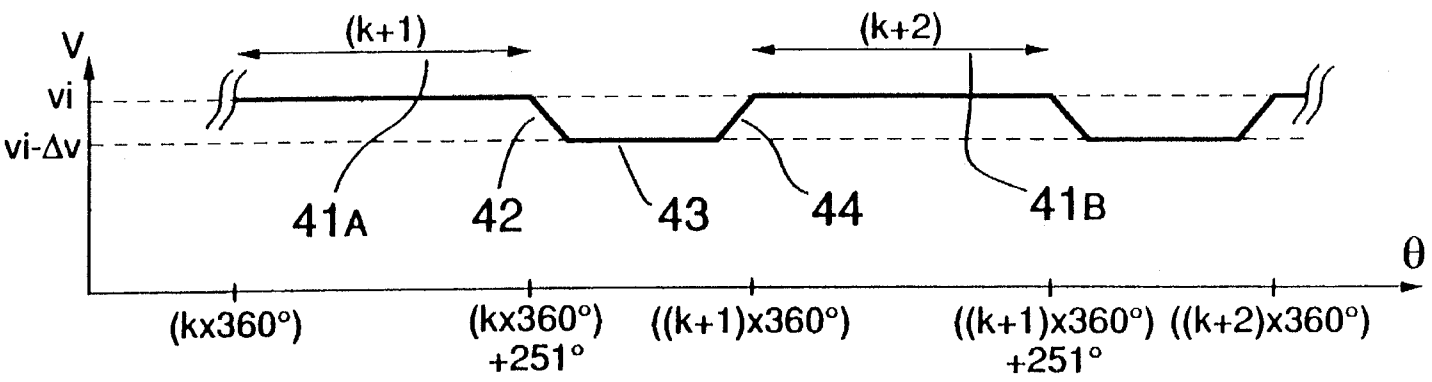
FIGS. 4*a* through 4*c* are curves showing the variation in the print head speed V as a function of the print head angular position θ in the respective cases where.
Figure 4B:
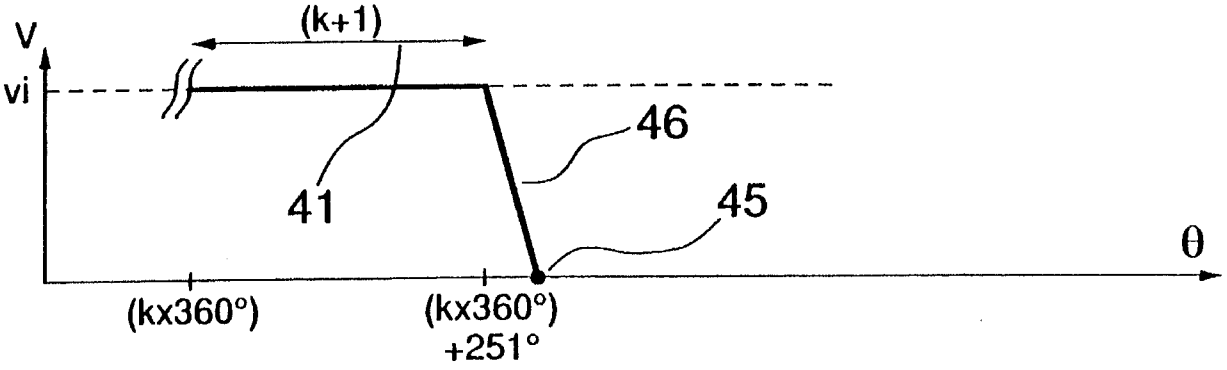
Figure 4C:
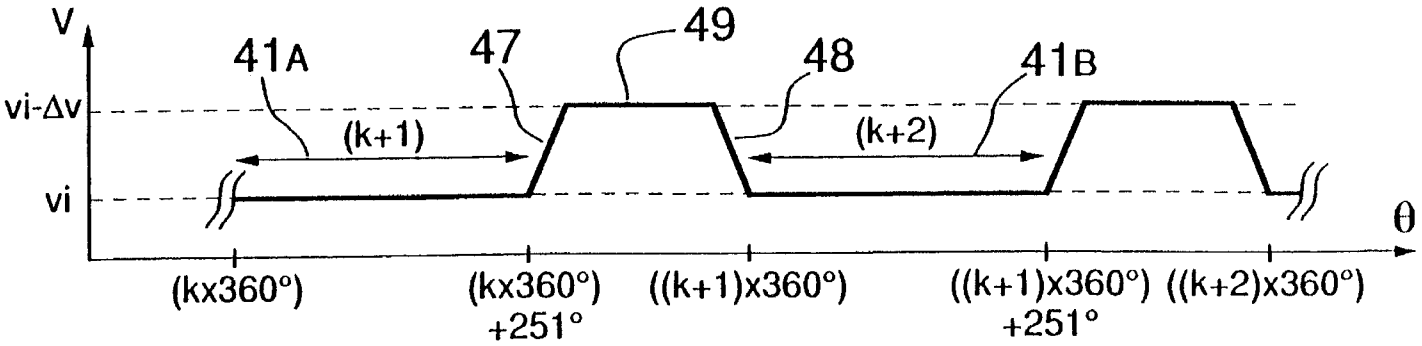

These three cases are respectively described hereinafter in relation to FIGS. 4*a* through 4*c*. To this end the curves show the variation in the print head speed V as a function of the print head angular position θ over one or two printing cycles.

In these figures the position θ=0° corresponds to the start of the first printing phase. In each figure the curve begins with the printing phase 41A of the (k+1)th cycle.

In the first case (FIG. 4*a*) the speed of the head during this (k+1)th printing phase 41A is equal to $v_i$. This speed $v_i$ is necessarily the conveyor speed because, as already explained, the conveyor speed and the printing head speed must be equal during printing.

The various values of this conveyor speed $v_i$ (with i varying from 1 through 5) will be explained in relation to FIGS. 5*a* and 5*b*.

After the print head has rotated 251° printing is completed. As in this situation the distance between two start of printing positions is greater than the circumference of the print head, it is necessary to decelerate the print head (phase 42). Thereafter, in order to compensate for this difference in distance, the print head rotates at a lower speed ($v_i$−v) (phase 43). Finally, it is accelerated (phase 44) to return to the speed $v_i$ so that it is at the correct speed for the next printing phase 41B (that of the (k+2)th cycle).

In the second case (FIG. 4*b*) there is no following envelope and the (k+1)th printing phase 41 is therefore the last.

The print head is therefore decelerated (46) to the stopped position 45. This stopped position is not random, but rather is such that the band and the inking stamps are not accessible. The deceleration phase 46 is as steep as possible.

In the third and final case (FIG. 4*c*) the distance between two start of printing positions is less than the circumference of the print head so that the print head must be accelerated (phase 47). Thereafter, to compensate for this difference in distance, the print head rotates at a higher speed ($v_i$+v) (phase 49). Finally, it is decelerated (phase 48) to return to the speed $v_i$ so that it is at the correct speed for the next printing cycle 41B (that of the (k+2)th cycle).

When the machine is started or when the rate at which envelopes arrive from the system on the entry side of the franking machine is changed, different types of problems arise:

when the machine starts, the conveyor speed necessarily assumes its maximum possible value. Consequently, during printing the print head will also rotate at this speed, which is very high. If the rate at which the envelopes arrive is not very fast, the print head will have to stop during the angular distance compensating period for the band to be correctly positioned relative to the next envelope;

when the conveyor speed has a high value $v_i$ the rate at which the envelopes arrive decreases. The situation is then the same as previously: the print head must be stopped during the compensation phase;

if the conveyor speed has a low value $v_i$, the rate at which the envelopes arrive increases. It is then necessary to accelerate the print head during the compensation phase.

In order to avoid the drawbacks of stopping or accelerating the print head during the compensation phase, the conveyor speed and consequently the speed of the print head are caused to evolve through a continuous learning process.

FIGS. 5*a* and 5*b* show this learning process, which avoids stopping (FIG. 5*a*) and acceleration (FIG. 5*b*) of the print head during the compensation phase.

Like FIGS. 4*a* through 4*c*, FIGS. 5*a* and 5*b* are curves showing the variation in the print head speed V as a function of the print head angular position θ over three printing cycles.

In each figure the curve starts with the printing phase 51 of the (k+1)th cycle.

FIG. 5*a* shows the situation in which the speed of the print head during the (k+1)th printing phase 51 is $v_0$ which is also the conveyor speed (the two speeds are equal during the printing phase) and corresponds to the maximal conveyor speed of the machine.

The conveyor speed may assume any of a choice of possible values from $v_0$ through $v_i$ where the subscript 0 indicates the highest speed and the highest subscript indicates the lowest speed.

The remainder of this description assumes that there are six choices $v_0$ through $v_5$.

In FIG. 5*a* the rate at which envelopes arrive is low.

The print head must therefore stop (52). On the next cycle the print head is still rotating at the speed $v_0$ during the (k+2)th printing phase 53. On the other hand, by virtue of the learning process, it no longer stops during the compensation phase: after deceleration (54) it rotates at a constant speed $v_1-\Delta v$ (phase 55). It then accelerates (56) to rotate at the speed $v_1$ during the (k+3)th printing phase 57. This speed $v_1$ is also the conveyor speed.

Similarly, the learning process continues over subsequent cycles by further reducing the conveyor speed if necessary (from $v_1$ to $v_2$, for example) until this value is optimized and the print head no longer stops if this is possible.

FIG. 5*b* shows the other case, that is to say that in which the speed of the print head during printing (this is also the conveyor speed) is lower and has the value $v_5$, for example.

In this figure it is assumed that the rate at which envelopes arrive is increasing.

The print head must therefore accelerate (59), rotate at a speed $v_5+\Delta v$ during the compensation phase 58 and then decelerate (60) to rotate at the speed $v_5$ during the (k+2)th printing phase.

On the other hand, because of the learning process, immediately after this (k+2)th printing phase 61 the print head accelerates up to a speed $v_0-\Delta v$ which is a compensation phase 63.

If the rate at which envelopes arrive has increased moderately, the print head accelerates only up to a lower speed $v_i-\Delta v$ taking a higher value of i.

When this compensation phase is completed, the print head is accelerated (64) and the (k+3)th printing phase 65 can take place at the speed $v_0$ (or $v_i$ where i is greater than 0).

In the subsequent cycles the print head is no longer accelerated during the compensation phase.

These two examples illustrate the role of the learning process which enables a reduction of the conveyor speed over several cycles (in the example of FIG. 5*a:* from $v_0$ to $v_1$) or an increase in this value over a single cycle (in the example of 5*b:* from $v_5$ to $v_0$).

During each printing cycle the speed of the print head assumes two distinct constant values:

- a first value throughout the printing phase (which is equal to the conveyor speed),
- a second value during part of the compensation phase.

Acceleration and deceleration phases provide for changing from the first value of the print head speed to the second.

The compensation phase therefore comprises:

- a phase in which the speed of the head assumes the second value,
- an acceleration phase,
- a deceleration phase.

In the embodiment that has just been described the acceleration and deceleration phases have the same duration.

The curve showing the variation in the print head speed as a function of the print head angular position respectively corresponds during the acceleration and deceleration phases to:

- a portion of curve equivalent to a straight line segment having a particular slope, and
- a portion of curve equivalent to a straight line segment having the same absolute slope but of the opposite sign.

It is clear that numerous other embodiments of the invention are feasible. In particular, it is possible to provide for compensation phases in which the curve representing the variation in the print head speed as a function of its angular position would no longer be made up of three straight line segments (respectively corresponding to the deceleration, constant speed and acceleration phases), but could be, for example:

- of triangular shape, the constant speed phase being eliminated by varying the acceleration and deceleration appropriately,
- of "softened" shape (having a cup-shaped profile, for example), still with the objective of reducing impact and noise. There would then be no sudden variation in speed.

More generally, the invention concerns all devices adapted to reduce variations in the speed of the print head, the latter never stopping under normal operating conditions.

There is claimed:

1. A method for controlling an on the fly franking machine wherein documents (20) fed into said machine at a feed rate are conveyed in series at a transport velocity along a conveyor path one behind the other and spaced apart from one another, each of said documents (20) being conveyed past a rotating print head, said print head being rotated at a circumferential surface velocity (V) said method comprising the steps of: providing a print head and a conveyor, said conveyor having a transport velocity, and said print head having a first angular portion (2) of its circumferential surface in contact with each document as the document is conveyed past said print head during a portion of a rotational cycle of the print head defining a printing phase, and said print head having a complementary angular portion (1) of its circumferential surface not in contact with said document as the document is conveyed past said print head during the remainder of the rotational cycle of the print head defining a compensation phase

- holding the surface velocity of said print head equal to said transport velocity during the printing phase of a first document,
- using a continuous learning process to vary said surface velocity of said print head by rotating said print head at a catch-up velocity to correctly position said first angular portion of the print head relative to a second document following said first document without stopping the rotation of said print head during said compensation phase, and
- using said continuous learning process to vary said transport velocity to hold said catch-up velocity as close as possible to said transport velocity during said compensation phase while preventing the overlapping of new consecutive documents as they are fed in series into said machine.

2. The method according to claim 1, wherein the transport velocity is varied towards equalization with one reference transport speed among a finite number of different predetermined reference transport speeds during a compensation phase.

3. The method according to claim 2, wherein the transport velocity is decreased over several compensation phases and is increased over a single compensation phase.

4. The method according to claim 1, wherein the surface velocity is increased and decreased during a printing phase.

5. The method according to claim 2, wherein the surface velocity is increased and decreased during a printing phase.

6. The method according to claim 3, wherein the surface velocity is increased and decreased during a printing phase.

* * * * *